US007682266B2

(12) United States Patent
Endo et al.

(10) Patent No.: US 7,682,266 B2
(45) **Date of Patent: *Mar. 23, 2010**

(54) GOLF BALL

(75) Inventors: Seiichiro Endo, Kobe (JP); Masatoshi Yokota, Kobe (JP)

(73) Assignee: SRI Sports Ltd., Kobe-shi (JP)

( * ) Notice: Subject to any disclaimer, the term of this patent is extended or adjusted under 35 U.S.C. 154(b) by 37 days.

This patent is subject to a terminal disclaimer.

(21) Appl. No.: 11/151,341

(22) Filed: Jun. 14, 2005

(65) Prior Publication Data

US 2006/0025238 A1 Feb. 2, 2006

(30) Foreign Application Priority Data

Jul. 29, 2004 (JP) ..... 2004-221003

(51) Int. Cl.
*A63B 37/06* (2006.01)

(52) U.S. Cl. ..... 473/373

(58) Field of Classification Search ..... 473/373, 473/374, 368

See application file for complete search history.

(56) References Cited

U.S. PATENT DOCUMENTS 5,779,563 A * 7/1998 Yamagishi et al. ..... 473/371
6,106,415 A 8/2000 Masutani et al.
6,652,392 B2 * 11/2003 Higuchi et al. ..... 473/374
2002/0058553 A1 5/2002 Higuchi et al.
2002/0091018 A1 * 7/2002 Sasaki et al. ..... 473/367
2004/0116623 A1 6/2004 Isogawa et al.

FOREIGN PATENT DOCUMENTS

JP 2001-000585 A 1/2001
JP 2002-085587 A 3/2002
JP 2002-186687 A 7/2002
JP 2004-000649 A 1/2004
JP 2004-187829 A 7/2004
WO WO-2005/011099 A2 2/2004

* cited by examiner

*Primary Examiner*—Raeann Trimiew
(74) *Attorney, Agent, or Firm*—Birch, Stewart, Kolasch & Birch, LLP

(57) ABSTRACT

Golf ball 2 has a spherical core 4, a mid layer 6 covering this core 4, a reinforcing layer 8 covering this mid layer 6, and a cover 10 covering this reinforcing layer 8. Base polymer of this mid layer 6 includes an ionomer resin as a principal component. Base polymer of this cover 10 includes a thermoplastic polyurethane elastomer as a principal component. The cover 10 has a thickness Tc of equal to or less than 0.6 mm. The cover 10 has a hardness Hc as measured with a Shore D type hardness scale of equal to or less than 54. The cover 10 has a volume V of equal to or less than 3.0 $cm^3$. A product obtained by multiplying the thickness Tc, the hardness Hc and the volume V is equal to or less than 90. The reinforcing layer 8 includes a thermosetting resin as a base polymer. The reinforcing layer has a thickness of 3 μm or greater and 50 μm or less.

9 Claims, 1 Drawing Sheet

GOLF BALL

This application claims priority on Patent Application No. 2004-221003 filed in JAPAN on Jul. 29, 2004, the entire contents of which are hereby incorporated by reference.

BACKGROUND OF THE INVENTION

1. Field of the Invention

The present invention relates to golf balls. More particularly, the present invention relates to multi piece golf balls having a core, a mid layer and a cover.

2. Description of the Related Art

Top concern to golf players for golf balls is their flight performances. The golf players particularly place great importance on flight distance yielded upon shots with a driver. The golf players also place great importance on flight distance yielded upon shots with a long iron and a middle iron.

Golf players also place great importance on spin performances of the golf balls. Great back spin rate results in small run. For golf players, golf balls which are liable to be spun backwards are apt to be rendered to stop at a targeted position. Great side spin rate results in easily curved trajectory of the golf ball. For golf players, golf balls which are liable to be spun sidewise are apt to allow the trajectory to curve intentionally. Golf balls that are excellent in spin performances are excellent in control performances. High-level golf players particularly place great importance on control performances upon shots with a short iron.

Feeling experienced upon impact of a golf ball is also important for high-level golf players. The golf players prefer soft feel upon impact as well as light feel upon impact. The golf players also prefer feeling to allow the launch direction to be readily controlled.

In light of the flight performances, control performances and feelings, golf balls having a variety of structures have been proposed. For example, U.S. Pat. No. 6,106,415 discloses a golf ball having a core, a mid layer comprising an ionomer resin and a cover comprising polyurethane.

Covers having high elasticity are advantageous in terms of the flight performance. However, the highly elastic covers liable to deteriorate the control performance and feeling. Soft covers are advantageous in terms of the control performance. However, the soft covers are disadvantageous in terms of the flight performance. Demands from the golf players for golf balls have increasingly escalated in recent years. Highly balanced flight performances, control performances and feelings have been desired. An object of the present invention is to provide golf balls exhibiting excellent flight performances, control performances and feelings.

SUMMARY OF THE INVENTION

A golf ball according to the present invention has a spherical core, a mid layer positioned outside of this core, and a cover positioned outside of this mid layer. This cover has a thickness Tc of equal to or less than 0.6 mm. This cover has a hardness Hc as measured with a Shore D type hardness scale of equal to or less than 54. This cover has a volume V of equal to or less than 3.0 $cm^3$. Product obtained by multiplying the thickness Tc (mm), the hardness Hc and the volume V ($cm^3$) of this cover is equal to or less than 90.

Preferably, product obtained by multiplying the hardness (Hc) and the volume V ($cm^3$) of the cover is equal to or less than 140.

Preferably, principal component of the base polymer of the cover is a thermoplastic polyurethane elastomer. Preferably, principal component of the base polymer of the mid layer is an ionomer resin. Preferably, a reinforcing layer is provided, which comprises a thermosetting resin as a base polymer, between the mid layer and the cover. This reinforcing layer has a thickness of 3 μm or greater and 50 μm or less.

A shot with a short iron results in a small amount of deformation of the golf ball due to low head speed. Upon the shot with the short iron, spin rate predominantly depends on the material of the cover surface. Because the golf ball according to the present invention has a cover having a hardness Hc of equal to or less than 54, slipping that occurs between the club face and the golf ball upon impact is suppressed. According to this golf ball, a great spin rate is achieved upon a shot with a short iron. This golf ball is excellent in a control performance upon a shot with a short iron.

Upon a shot with a driver, the mid layer and the core are also deformed greatly in addition to the cover. Covers having a low hardness Hc may be disadvantageous in terms of resilience performances, however, less adverse effects are exerted on the resilience performance because this cover is extremely thin. This golf ball is excellent in a flight performance upon a shot with a driver.

Spin rate predominantly depends on deformative behavior of the cover upon a shot with a long iron and a middle iron. Because this cover has a small volume V, the amount of deformation is small irrespective of the hardness Hc being small. Spin rate upon impact of this golf ball with a long iron or a middle iron is low. Low spin rate leads to a great flight distance. This golf ball is excellent in a flight performance upon a shot with a long iron and a middle iron.

Because this golf ball has a product obtained by multiplying the thickness Tc (mm), the hardness Hc and the volume V ($cm^3$) of equal to or less than 90, it easily gets on a clubface upon impact with a driver, and can be favorably delivered from the club. The getting on the clubface is responsible for stabilization of the launch direction of the golf ball. Favorable delivery of the ball results in a light feel at impact. According to this golf ball, an excellent feeling is experienced.

DESCRIPTION OF THE PREFERRED EMBODIMENTS

Figure 1:
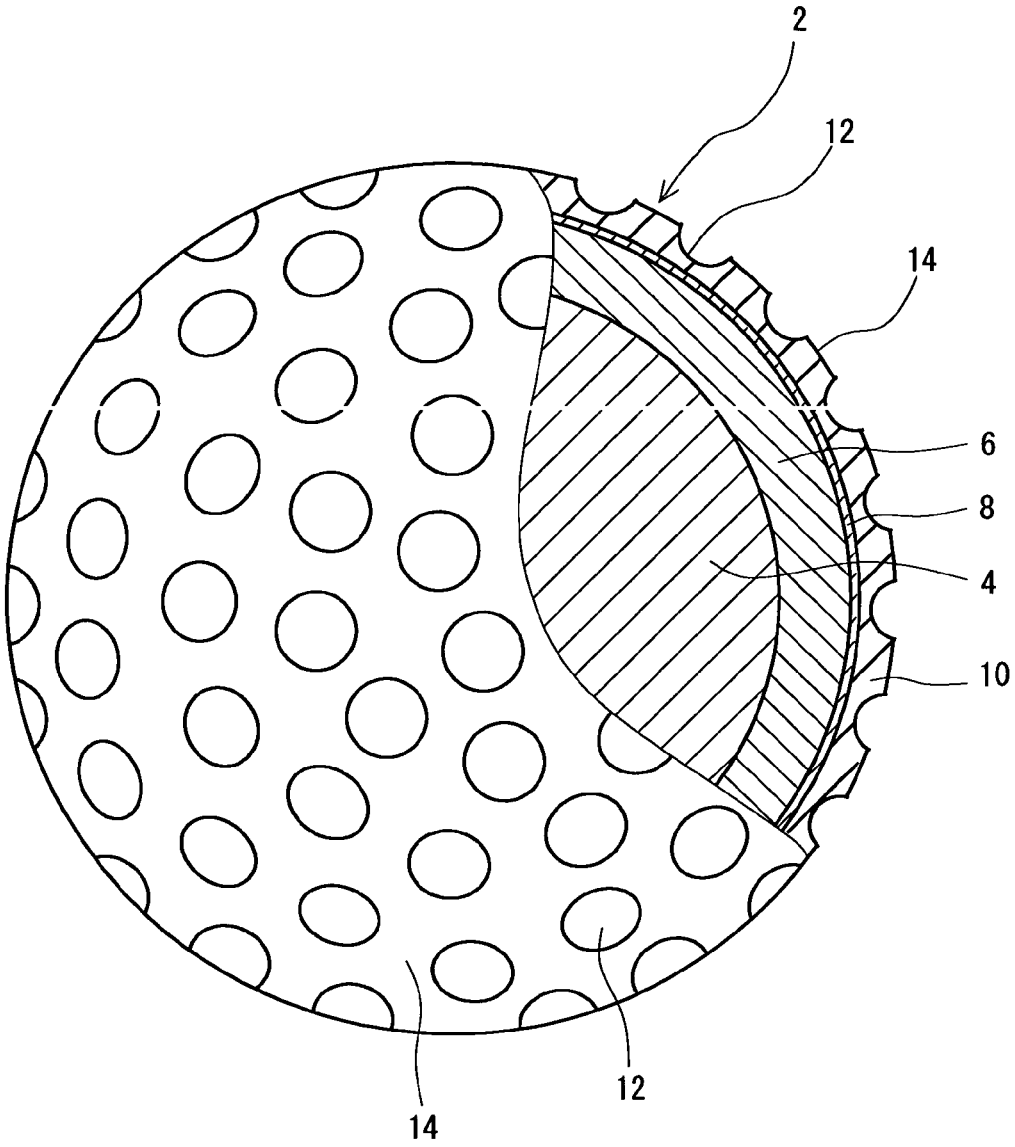
FIG. 1 is a partially cut off cross-sectional view illustrating a golf ball according to one embodiment of the present invention.

The present invention is hereinafter described in detail with appropriate references to the accompanying drawing according to the preferred embodiments.

A golf ball 2 depicted in FIG. 1 has a spherical core 4, a mid layer 6 covering this core 4, a reinforcing layer 8 covering this mid layer 6, and a cover 10 covering this reinforcing layer 8. Numerous dimples 12 are formed on the surface of the cover 10. Of the surface of the cover 10, a part except for the dimples 12 is a land 14. Although this golf ball 2 has a paint layer and a mark layer to the external side of the cover 10, these layers are not shown in the FIGURE.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. Weight of this golf ball 2 is 40 g or greater and 50 g or less. In light of attainment of great inertia, the weight is preferably equal to or greater than 44 g, and more preferably equal to or greater than 45.00 g. From the standpoint of conformity to a rule defined by USGA, the weight is preferably equal to or less than 45.93 g.

The core 4 is obtained through crosslinking of a rubber composition. Examples of preferred base rubber include polybutadienes, polyisoprenes, styrene butadiene copolymers, ethylene-propylene-diene copolymers and natural rubbers. In light of the resilience performance, polybutadienes are preferred. When other rubber is used in combination with polybutadiene, it is preferred that polybutadiene is included as a principal component. Specifically, the proportion of polybutadiene occupying in total base rubber is preferably equal to or greater than 50% by weight, and particularly preferably equal to or greater than 80% by weight. Polybutadienes, which have a percentage of cis-1,4 bond of equal to or greater than 40%, and particularly equal to or greater than 80%, are preferred.

For crosslinking of the core 4, a co-crosslinking agent is usually used. Preferable co-crosslinking agent in light of the resilience performance is a monovalent or bivalent metal salt of an α,β-unsaturated carboxylic acid having 2 to 8 carbon atoms. Specific examples of preferable co-crosslinking agent include zinc acrylate, magnesium acrylate, zinc methacrylate and magnesium methacrylate. Zinc acrylate and zinc methacrylate are particularly preferred on the ground that a high resilience performance can be achieved.

As a co-crosslinking agent, an α,β-unsaturated carboxylic acid having 2 to 8 carbon atoms, and an oxidized metal may be blended. Both components react in the rubber composition to give a salt. This salt is responsible for the crosslinking reaction. Examples of preferable α,β-unsaturated carboxylic acid include acrylic acid and methacrylic acid. Examples of preferable oxidized metal include zinc oxide and magnesium oxide.

The amount of the co-crosslinking agent to be blended is preferably 10 parts by weight or greater and 50 parts by weight or less per 100 parts by weight of the base rubber. When the amount is less than the above range, the resilience performance of the golf ball 2 may become insufficient. In this respect, the amount is more preferably equal to or greater than 15 parts by weight. When the amount is beyond the above range, hard feel at impact of the golf ball 2 may be experienced. In this respect, the amount is more preferably equal to or less than 45 parts by weight.

It is preferred that an organic peroxide is blended together with the co-crosslinking agent into the rubber composition for use in the core 4. The organic peroxide serves as a crosslinking initiator. By blending the organic peroxide, the resilience performance of the golf ball 2 may be improved. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

The amount of the organic peroxide to be blended is preferably 0.1 part by weight or greater and 3.0 parts by weight or less per 100 parts by weight of the base rubber. When the amount is less than the above range, the resilience performance of the golf ball 2 may become insufficient. In this respect, the amount is more preferably equal to or greater than 0.3 part by weigh, and particularly preferably equal to or greater than 0.5 part by weight. When the amount is beyond the above range, hard feel at impact of the golf ball 2 may be experienced. In this respect, the amount is more preferably equal to or less than 2.5 parts by weight.

A filler may be blended into the core 4 for the purpose of adjusting specific gravity and the like. Illustrative examples of suitable filler include zinc oxide, barium sulfate, calcium carbonate and magnesium carbonate. Also, powder of a highly dense metal may be blended as a filler. Specific examples of the highly dense metal include tungsten and molybdenum. The amount of the filler to be blended is determined ad libitum so that the intended specific gravity of the core 4 can be accomplished. Particularly preferable filler is zinc oxide. Zinc oxide serves not only in adjusting specific gravity but also as a crosslinking activator. Various kinds of additives such as sulfur, a sulfur compound, an anti-aging agent, a coloring agent, a plasticizer, a dispersant and the like may be blended in an appropriate amount to the core 4 as needed. The core 4 may be also blended with crosslinked rubber powder or synthetic resin powder.

Amount of compressive deformation of the core 4 is preferably equal to or less than 5.0 mm, more preferably equal to or less than 4.5 mm, and particularly preferably equal to or less than 4.0 mm. When the golf ball 2 is hit with a driver, the core 4 is deformed greatly in conjunction with the cover 10 and the mid layer 6. The core 4 having a small amount of compressive deformation is responsible for a flight performance upon a shot with a driver. Too small amount of compressive deformation may result in deteriorated feel at impact. In light of the feel at impact, the amount of compressive deformation is preferably equal to or greater than 1.5 mm, and particularly preferably equal to or greater than 2.0 mm.

For the measurement of the amount of compressive deformation, a core 4 is first placed on a hard plate made of metal. Next, a cylinder made of metal gradually descends toward the core 4. Accordingly, the core 4, which is sandwiched between the bottom face of the cylinder and the hard plate, is deformed. A migration distance of the cylinder, starting from the state in which initial load of 98 N is applied to the core 4 up to the state in which final load of 1274 N is applied thereto is the amount of compressive deformation.

The core 4 preferably has a diameter of 25 mm or greater and 41.5 mm or less. The core 4 preferably has a weight of 25 g or greater and 42 g or less. Crosslinking temperature of the core 4 is usually 140° C. or greater and 180° C. or less. The crosslinking time period of the core 4 is usually 10 minutes or longer and 60 minutes or less. The core 4 may be formed with two or more layers.

A thermoplastic resin composition is suitably used for the mid layer 6. Examples of the base polymer of the resin composition include ionomer resins, thermoplastic polyester elastomers, thermoplastic polyamide elastomers, thermoplastic polyurethane elastomers, thermoplastic polyolefin elastomers and thermoplastic polystyrene elastomers. In particular, ionomer resins are preferred. Ionomer resins are highly elastic. The ionomer resin is responsible for a flight performance upon a shot with a driver.

Other resin may be used in combination with the ionomer resin. In case of the use in combination, the ionomer resin is included as a principal component of the base polymer in light of the flight performance. Proportion of the ionomer resin occupying in the total base polymer is preferably equal to or greater than 50% by weight, more preferably equal to or greater than 70% by weight, and particularly preferably equal to or greater than 85% by weight.

Preferably, an ionomer resin is used that is a copolymer of α-olefin and an α,β-unsaturated carboxylic acid having 3 to 8 carbon atoms in which a part of the carboxylic acid is neutralized with a metal ion. Examples of preferable α-olefin include ethylene and propylene. Examples of preferable α,β-unsaturated carboxylic acid include acrylic acid and methacrylic acid. Illustrative examples of the metal ions for use in the neutralization include sodium ion, potassium ion, lithium ion, zinc ion, calcium ion, magnesium ion, aluminum ion and neodymium ion. The neutralization may also be carried out with two or more kinds of the metal ions. In light of the resilience performance and durability of the golf ball 2, particularly suitable metal ions are sodium ion, zinc ion, lithium ion and magnesium ion.

Specific examples of the ionomer resin include trade names "Himilan 1555", "Himilan 1557", "Himilan 1605", "Himilan 1706", "Himilan 1707", "Himilan AM7311", "Himilan AM7315", "Himilan AM7317", "Himilan AM7318" and "Himilan MK7320", available from Du Pont-MITSUI POLYCHEMICALS Co., Ltd.; trade names "Surlyn® 7930", "Surlyn® 7940", "Surlyn® 8140", "Surlyn® 8940", "Surlyn® 8945", "Surlyn® 9120", "Surlyn® 9910" and "Surlyn® 9945", available from Dupont; and trade names "IOTEK 7010", "IOTEK 7030", "IOTEK 8000" and "IOTEK 8030", available from EXXON Corporation. Two or more kinds of ionomer resins may be used in combination.

Into the resin composition of the mid layer 6 may be blended a filler for the purpose of adjusting specific gravity and the like. Illustrative examples of suitable filler include zinc oxide, barium sulfate, calcium carbonate and magnesium carbonate. Powder of a highly dense metal may be also blended as a filler. Specific examples of the highly dense metal include tungsten and molybdenum. The amount of the filler to be blended is determined ad libitum so that the intended specific gravity of the mid layer 6 can be accomplished. Into the mid layer 6 may be also blended a coloring agent, crosslinked rubber powder or synthetic resin powder.

In light of the flight performance upon a shot with a driver, hardness Hm of the mid layer 6 is preferably equal to or greater than 55, more preferably equal to or greater than 58, and particularly preferably equal to or greater than 60. When the hardness Hm is extremely great, to achieve a favorable feeling upon impact of the golf ball 2 may become difficult. In this respect, the hardness Hm is preferably equal to or less than 72, more preferably equal to or less than 70, and particularly preferably equal to or less than 68.

In the present invention, the hardness Hm of the mid layer 6 and the hardness Hc of the cover 10 are measured in accordance with a standard of "ASTM-D 2240-68". For the measurement, an automated rubber hardness scale which is equipped with a Shore D type spring hardness scale (trade name "LA1", available from Koubunshi Keiki Co., Ltd.) is used. For the measurement, a sheet which is formed by hot press is used having a thickness of about 2 mm and consisting of the same material as the mid layer 6 (or the cover 10). Prior to the measurement, the sheet is stored at a temperature of 23° C. for two weeks. When the measurement is carried out, three sheets are overlaid.

Thickness Tm of the mid layer 6 is preferably 0.3 mm or greater and 2.5 mm or less. When the thickness Tm is less than the above range, a flight performance upon a shot with a driver may become insufficient. In this respect, the thickness Tm is more preferably equal to or greater than 0.5 mm, and particularly preferably equal to or greater than 0.7 mm. When the thickness Tm is beyond the above range, to achieve a favorable feeling upon impact of the golf ball 2 may become difficult. In this respect, the thickness Tm is more preferably equal to or less than 2.0 mm.

In light of adhesion between the mid layer 6 and the reinforcing layer 8 or the cover 10, the surface of the mid layer 6 is preferably subjected to a surface treatment to increase the roughness thereof. Specific examples of the treatment include brushing, grinding and the like.

The reinforcing layer 8 lies between the mid layer 6 and the cover 10 to elevate the adhesiveness therebetween. As described later, the cover 10 of this golf ball 2 is very thin. When such a thin cover 10 is hit with an edge of a clubface, a wrinkle is liable to be generated. The reinforcing layer 8 suppresses generation of such a wrinkle.

For the base polymer of the reinforcing layer 8, a two-component cured thermosetting resin may be suitably used. Specific examples of the two-component cured thermosetting resin include epoxy resins, urethane resins, acrylic resins, polyester based resins and cellulose based resins. In light of the mechanical strength (e.g., strength at break) and durability of the reinforcing layer 8, two-component cured epoxy resins and two-component cured urethane resins are preferred.

The two-component cured epoxy resin is obtained by curing an epoxy resin with a polyamide based curing agent. Illustrative examples of the epoxy resin for use in the two-component cured epoxy resin include bisphenol A type epoxy resin, bisphenol F type epoxy resin and bisphenol AD type epoxy resin. The bisphenol A type epoxy resin is obtained by a reaction of bisphenol A with an epoxy group-containing compound such as epichlorohydrin. The bisphenol F type epoxy resin is obtained by a reaction of bisphenol F with an epoxy group-containing compound. The bisphenol AD type epoxy resin is obtained by a reaction of bisphenol AD with an epoxy group-containing compound. In light of the balance among softness, chemical resistance, heat resistance and toughness, bisphenol A type epoxy resins are preferred.

The polyamide based curing agent has multiple amino groups and one or more amide groups. This amino group can react with an epoxy group. Specific examples of the polyamide based curing agent include polyamide amine curing agents and denatured products of the same. The polyamide amine curing agent is obtained by a condensation reaction of a polymerized fatty acid with a polyamine. Typical polymerized fatty acid may be obtained by heating natural occurring fatty acids containing large amounts of unsaturated fatty acids such as linoleic acid, linolenic acid and the like in the presence of a catalyst to perfect the synthesis. Specific examples of the unsaturated fatty acid include tall oil, soybean oil, linseed oil and fish oil. A polymerized fatty acids having a dimer content of equal to or greater than 90% by weight and a trimer content of equal to or less than 10% by weight, and being hydrogenated are preferred. Illustrative examples of preferred polyamine include polyethylene diamine, polyoxyalkylene diamine and derivatives thereof.

Upon mixing of the epoxy resin and the polyamide based curing agent, ratio of epoxy equivalent of the epoxy resin and amine active hydrogen equivalent of the polyamide based curing agent is preferably 1.0/1.4 or greater and 1.0/1.0 or less.

The two-component cured urethane resin is obtained by a reaction of a base material and a curing agent. A two-component cured urethane resin obtained by a reaction of a base material containing a polyol component with a curing agent containing polyisocyanate or a derivative thereof, or a two-component cured urethane resin obtained by a reaction of a base material containing isocyanate group-ended urethane prepolymer with a curing agent having an active hydrogen may be used. In particular, two-component cured urethane resins prepared by a reaction of a base material containing a polyol component with a curing agent containing polyisocyanate or a derivative thereof are preferred.

It is preferred that urethane polyol is used as the polyol component of the base material. The urethane polyol has urethane bonds and at least two hydroxyl groups. Preferably, the urethane polyol has a hydroxyl group at its end. The urethane polyol may be obtained by allowing polyol and polyisocyanate to react at a ratio such that an excessive molar ratio of the hydroxyl group of the polyol component to the isocyanate group of polyisocyanate is attained.

The polyol for use in production of the urethane polyol has multiple hydroxyl groups. Polyol having a weight average molecular weight of 50 or greater and 2000 or less, and particularly 100 or greater and 1000 or less is preferred. Examples of the polyol having a low molecular weight include diol and triol. Specific examples of the diol include ethylene glycol, diethylene glycol, triethylene glycol, 1,3-butanediol, 1,4-butanediol, neopentyl glycol and 1,6-hexanediol. Specific examples of the triol include trimethylolpropane and hexanetriol. Examples of the polyol having a high molecular weight include polyether polyols such as polyoxyethylene glycol (PEG), polyoxypropylene glycol (PPG) and polyoxytetramethylene glycol (PTMG); condensed polyester polyols such as polyethylene adipate (PEA), polybutylene adipate (PBA) and polyhexamethylene adipate (PHMA); lactone based polyester polyols such as poly-ε-caprolactone (PCL); polycarbonate polyols such as polyhexamethylene carbonate; and acrylic polyols. Two or more kinds of polyols may be used in combination.

Polyisocyanate for use in production of urethane polyol has multiple isocyanate groups. Specific examples of the polyisocyanate include aromatic polyisocyanates such as 2,4-toluene diisocyanate, 2,6-toluene diisocyanate, mixtures of 2,4-toluene diisocyanate and 2,6-toluene diisocyanate (TDI), 4,4'-diphenylmethane diisocyanate (MDI) 1,5-naphthylene diisocyanate (NDI), 3,3'-bitolylene-4,4'-diisocyanate (TODI), xylylene diisocyanate (XDI), tetramethylxylylene diisocyanate (TMXDI) and paraphenylene diisocyanate (PPDI), alicyclic polyisocyanates such as 4,4'-dicyclohexylmethane diisocyanate ($H_{12}$MDI), hydrogenated xylylene diisocyanate ($H_6$XDI), hexamethylene diisocyanate (HDI) and isophorone diisocyanate (IPDI); and aliphatic polyisocyanates. Two or more polyisocyanates may be used in combination. In light of the weather resistance, TMXDI, XDI, HDI, $H_6$XDI, IPDI and $H_{12}$MDI are preferred.

In the reaction of polyol and polyisocyanate for producing the urethane polyol, any known catalyst may be used. Typical catalyst may be dibutyltin dilaurate.

In light of strength of the reinforcing layer 8, ratio of the urethane bonds included in the urethane polyol is preferably equal to or greater than 0.1 mmol/g. In light of the following capability of the reinforcing layer 8 to the cover 10, the ratio of the urethane bonds included in the urethane polyol is preferably equal to or less than 5 mmol/g. The ratio of the urethane bonds may be adjusted by adjusting the molecular weight of the polyol to be a raw material, and by adjusting compounding ratio of the polyol and the polyisocyanate.

In light of a short time period required for the reaction of the base material with the curing agent, the urethane polyol has a weight average molecular weight of preferably equal to or greater than 4000, and more preferably equal to or greater than 4500. In light of the adhesiveness of the reinforcing layer 8, the urethane polyol has a weight average molecular weight of preferably equal to or less than 10000, and more preferably equal to or less than 9000.

In light of the adhesiveness of the reinforcing layer 8, the urethane polyol has a hydroxyl value (mgKOH/g) of preferably equal to or greater than 15, and more preferably equal to or greater than 73. In light of a short time period required for the reaction of the base material with the curing agent, the urethane polyol has a hydroxyl value of preferably equal to or less than 130, and more preferably equal to or less than 120.

The base material may contain, in addition to the urethane polyol, a polyol not having any urethane bond. The aforementioned polyol that is a raw material of the urethane polyol may be used in the base material. Polyols that are miscible with the urethane polyol are preferred. In light of a short time period required for the reaction of the base material with the curing agent, proportion of the urethane polyol in the base material is preferably equal to or greater than 50% by weight and more preferably equal to or greater than 80% by weight based on the solid content. Ideally, this proportion is 100% by weight.

The curing agent contains polyisocyanate or a derivative thereof. The aforementioned polyisocyanate that is a raw material of the urethane polyol may be used in the curing agent.

The reinforcing layer 8 may include additives such as a coloring agent (typically, titanium dioxide), a phosphate based stabilizer, an antioxidant, a light stabilizer, a fluorescent brightening agent, an ultraviolet absorbent, a blocking preventive agent and the like. The additive may be added to the base material of the two-component cured thermosetting resin, or may be added to the curing agent.

The reinforcing layer 8 is obtained by coating a liquid, which is prepared by dissolving or dispersing a base material and a curing agent in a solvent, on the surface of the mid layer 6. In light of the workability, coating with a spray gun is preferred. The solvent is volatilized after the coating to permit a reaction of the base material with the curing agent thereby forming the reinforcing layer 8. Illustrative examples of preferred solvent include toluene, isopropyl alcohol, xylene, methyl ethyl ketone, methyl isobutyl ketone, ethylene glycol monomethyl ether, ethylbenzene, propylene glycol monomethyl ether, isobutyl alcohol and ethyl acetate.

In light of suppression of a wrinkle, the reinforcing layer 8 has a thickness of preferably equal to or greater than 3 μm, and more preferably equal to or greater than 5 μm. In light of easy formation of the reinforcing layer 8, it is preferred that the thickness is equal to or less than 300 μm, still more, equal to or less than 100 μm, yet more, equal to or less than 50 μm, and further, equal to or less than 20 μm. The thickness is measured by observation of the cross section of the golf ball 2 with a micro scope. When the surface of the mid layer 6 has roughness resulting from the surface roughening treatment, the thickness is measured immediately above the protruded portion.

In light of suppression of the wrinkle, the reinforcing layer 8 has a pencil hardness of preferably equal to or greater than 4B, and more preferably equal to or greater than B. In light of small loss of the force during transfer from the cover 10 to the mid layer 6 upon hit of the golf ball 2, the reinforcing layer 8 has a pencil hardness of preferably equal to or less than 3H. The pencil hardness is measured in accordance with a standard of "JIS K5400".

When sufficient adhesion between the mid layer 6 and the cover 10 is accomplished leading to less possibility to generate a wrinkle, the reinforcing layer 8 may not be provided.

A thermoplastic resin composition is suitably used for the cover 10. Examples of base polymer of this resin composition include thermoplastic polyurethane elastomers, thermoplastic polyester elastomers, thermoplastic polyamide elastomers, thermoplastic polyolefin elastomers, thermoplastic polystyrene elastomers and ionomer resins. In particular, thermoplastic polyurethane elastomers are preferred. The thermoplastic polyurethane elastomers are soft. Great spin rate is achieved upon hit with a short iron of the golf ball 2 having a cover 10 comprising a thermoplastic polyurethane elastomer. The cover 10 comprising a thermoplastic polyurethane elastomer is responsible for a control performance upon a shot with a short iron. The thermoplastic polyurethane elastomer is also responsible for the scuff resistance of the cover 10.

Other resin may be used in combination with the thermoplastic polyurethane elastomer. In light of the control performance, the thermoplastic polyurethane elastomer is included in the base polymer as a principal component when used in combination. Proportion of the thermoplastic polyurethane elastomer occupying in total base polymer is preferably equal to or greater than 50% by weight, more preferably equal to or greater than 70% by weight, and particularly preferably equal to or greater than 85% by weight.

The thermoplastic polyurethane elastomer includes a polyurethane component as a hard segment, and a polyester component or a polyether component as a soft segment. Illustrative examples of the curing agent for the polyurethane component include alicyclic diisocyanate, aromatic diisocyanate and aliphatic diisocyanate. In particular, alicyclic diisocyanate is preferred. Because the alicyclic diisocyanate has no double bond in the main chain, yellowing of the cover 10 can be suppressed. Additionally, because the alicyclic diisocyanate is excellent in strength, the cover 10 can be prevented from being scuffed. Two or more kinds of diisocyanates may be used in combination.

Illustrative examples of the alicyclic diisocyanate include 4,4'-dicyclohexylmethane diisocyanate ($H_{12}MDI$), 1,3-bis (isocyanatomethyl)cyclohexane ($H_6XDI$), isophorone diisocyanate (IPDI) and trans-1,4-cyclohexane diisocyanate (CHDI). In light of versatility and processability, $H_{12}MDI$ is preferred.

Illustrative examples of the aromatic diisocyanate include 4,4'-diphenylmethane diisocyanate (MDI) and toluene diisocyanate (TDI). Illustrative examples of the aliphatic diisocyanate include hexamethylene diisocyanate (HDI).

Specific examples of the thermoplastic polyurethane elastomer include trade name "Elastolan XNY90A", trade name "Elastolan XNY97A", trade name "Elastolan XNY585" and trade name "Elastolan XKP016N", available from BASF Japan Ltd; and trade name "Rezamin P4585LS" and trade name "Rezamin PS62490", available from Dainichiseika Color & Chemicals Mfg. Co., Ltd.

Into the cover 10 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. Also, the cover 10 may be blended with powder of a highly dense metal such as tungsten, molybdenum or the like for the purpose of adjusting the specific gravity.

The cover 10 has a Shore D hardness Hc of equal to or less than 54. By employing such a soft cover 10, a favorable control performance may be achieved upon a shot with a short iron. In light of the control performance, it is preferred that the hardness Hc is equal to or less than 50, still more, equal to or less than 47, and further, equal to or less than 42. When the hardness is too small, a flight performance upon a shot with a driver, a long iron and a middle iron may be insufficient. In this respect, it is preferred that the hardness Hc is equal to or greater than 20, still more, equal to or greater than 28, and further, equal to or greater than 33.

The cover 10 has a thickness Tc of equal to or less than 0.6 mm. As described above, the cover 10 has a low hardness. The cover 10 having such a low hardness is disadvantageous in terms of resilience coefficient of the golf ball 2. Upon a shot with a driver, the mid layer 6 as well as the core 4 of the golf ball 2 is deformed greatly. By setting the thickness Tc to be equal to or less than 0.6 mm, the cover 10 does not adversely affect the resilience coefficient to a large extent upon a shot with a driver, even though the cover 10 has a low hardness. An excellent flight performance can be achieved upon a shot with a driver through using the ionomer resin in the mid layer 6.

In light of the flight performance, the thickness Tc is more preferably equal to or less than 0.5 mm, and particularly preferably equal to or less than 0.4 mm. When the thickness Tc is too small, a difficulty may be involved in forming the cover 10. In this respect, the thickness Tc is preferably equal to or greater than 0.1 mm, and more preferably equal to or greater than 0.2 mm.

The cover 10 has a volume V of equal to or less than 3.0 $cm^3$. Spin rate yielded upon hit of the golf ball 2 with a long iron or a middle iron predominantly depends on deformative behavior of the cover 10. Amount of deformation of the cover 10 can be reduced by setting the volume V of the cover 10 to be equal to or less than 3.0 $cm^3$, irrespective of small hardness Hc. The spin rate yielded upon hit of the golf ball 2 with a long iron or a middle iron is low. Low spin rate leads to a great flight distance. This golf ball 2 is excellent in a flight performance upon a shot with a long iron and a middle iron.

In light of the flight performance, the volume V is preferably equal to or less than 2.7 $cm^3$, more preferably equal to or less than 2.4 $cm^3$, and particularly preferably equal to or less than 2.2 $cm^3$. When the volume V is too small, a difficulty may be involved in forming the cover 10. In this respect, the volume V is preferably equal to or greater than 0.3 $cm^3$, and more preferably equal to or greater than 1.0 $cm^3$.

In this golf ball 2, a product (Tc * Hc * V) obtained by multiplying the thickness Tc (mm), the hardness Hc and the volume V ($cm^3$) is equal to or less than 90. This golf ball 2 easily gets on a clubface upon impact with a driver, and can be favorably delivered from the club. Such getting on a clubface is responsible for stabilization of the launch direction of the golf ball 2. Favorable delivery results in a light feel at impact. According to this golf ball 2, an excellent feeling is experienced.

In light of the feeling, the product (Tc * Hc * V) is preferably equal to or less than 85, more preferably equal to or less than 82, and particularly preferably equal to or less than 60. The product (Tc * Hc * V) is usually equal to or greater than 1.0.

In light of the feeling, a product (Hc * V) obtained by multiplying the hardness Hc and the volume V ($cm^3$) is preferably equal to or less than 140, and more preferably equal to or less than 115. The product (Hc * V) is usually equal to or greater than 10.

EXAMPLES

Example 1

A rubber composition was obtained by kneading 100 parts by weight of polybutadiene (trade name "BR-730", available from JSR Corporation), 35 parts by weight of zinc diacrylate, an appropriate amount of zinc oxide, 0.7 part by weight of bis(pentabromophenyl)disulfide and 0.9 part by weight of dicumyl peroxide. This rubber composition was placed into a mold having upper and lower mold half each having a hemispherical cavity, and heated under a temperature of 170° C. for 15 minutes to obtain a core having a diameter of 38.5 mm. This core had a weight of 34.9 g.

A resin composition was obtained by kneading 50 parts by weight of an ionomer resin (Himilan 1605, described above)

50 parts by weight of other ionomer resin (Surlyn® 9945, described above), 4 parts by weight of titanium dioxide and 0.1 part by weight of a coloring agent (ultramarine blue) in a biaxial extruder. This resin composition was rendered to cover around the core by injection molding to obtain a mid layer. This mid layer had a hardness Hm of 63.

A coating composition containing a two-component cured epoxy resin as a base polymer (trade name "Polin 750LE", available from Shinto Paint Co., Ltd.) was prepared. The base material liquid of this coating composition consists of 30 parts by weight of bisphenol A type solid epoxy resin and 70 parts by weight of a solvent. The curing agent liquid of this coating composition consists of 40 parts by weight of denatured polyamide amine, 55 parts by weight of a solvent and 5 parts by weight of titanium dioxide. Weight ratio of the base material liquid and the curing agent liquid is 1/1. This coating composition was coated on the surface of the mid layer with a spray gun, and kept in an atmosphere of 40° C. for 24 hours to give a reinforcing layer.

A type d resin composition shown in Table 1 below was obtained with a biaxial extruder. Half shells were obtained from this resin composition with compression molding. A spherical body comprising the core, the mid layer and the reinforcing layer were covered by two pieces of the half shell, which was placed into a mold having upper and lower mold half each having a hemispherical cavity to obtain a cover with compression molding. A paint layer was formed around this cover to give a golf ball of Example 1. This golf ball had a diameter of 42.7 mm.

TABLE 1

| | Specification of cover | | | | | |
|---|---|---|---|---|---|---|
| | Type | | | | | |
| | a | b | c | d | e | f |
| Rezamin PS62490 | 100 | — | — | — | — | — |
| Rezamin P4585LS | — | 100 | — | — | — | — |
| Elastolan XNY90A | — | — | 100 | — | — | — |
| Elastolan XNY97A | — | — | — | 100 | 35 | — |
| Elastolan XKP016N | — | — | — | — | 65 | 100 |
| Titanium dioxide | 4 | 4 | 4 | 4 | 4 | 4 |
| Ultramarine blue | 0.1 | 0.1 | 0.1 | 0.1 | 0.1 | 0.1 |
| Hardness (Shore D) | 28 | 33 | 42 | 47 | 54 | 58 |

Examples 2 to 10 and Comparative Examples 1 to 3

In a similar manner to Example 1, golf balls with specifications as presented in Table 2 and Tale 3 below were obtained. A coating composition comprising a two-component cured urethane resin as a base polymer was used in the reinforcing layer in Example 4. In production of this coating composition, 116 parts by weight of PTMG and 16 parts by weight of 1,2,6-hexanetriol were first dissolved in 120 parts by weight of a solvent (mixed liquid of toluene and methyl ethyl ketone). To this solution was added dibutyltin dilaurate to give the concentration of 0.1% by weight. To this solution was added 48 parts by weight of isophorone diisocyanate dropwise while keeping at 80° C. to obtain a base material liquid containing urethane polyol. Solid content of this urethane polyol was 60% by weight, with a hydroxyl value being 87 mgKOH/g, and with a weight average molecular weight being 7850. This base material liquid and a curing agent liquid containing isophorone diisocyanate (manufactured by Sumitomo Bayer Urethane Co., Ltd.) were mixed to give a molar ratio of NCO/OH being 1.2. To this liquid were added a light stabilizer (trade name "Sanol LS770", available from Sankyo Co., Ltd.), an ultraviolet ray absorbing agent (trade name "TINUVIN® 900", available from Ciba-Geigy Co.) and a fluorescent brightening agent (trade name "UVITEX® OB", available from Ciba-Geigy Co.") to prepare a coating composition. Amounts as added per 100 parts by weight of the urethane resin component are 2 parts by weight for the light stabilizer, 2 parts by weight for the ultraviolet ray absorbing agent and 0.2 part by weight of the fluorescent brightening agent.

[Shot with Driver]

A driver with a metal head was attached to a swing machine available from Golf Laboratory Co. Then the machine condition was set to give the head speed of 50 m/sec, and the golf balls were hit therewith. Accordingly, ball speed immediately after the hit and travel distance (i.e., the distance from the launching point to the point where the ball stopped) were measured. Mean values of 10 times measurement are shown in Table 2 and Table 3 below.

[Shot with Middle Iron]

To the swing machine described above was attached a number five iron. Then the machine condition was set to give the head speed of 41 m/sec, and the golf balls were hit therewith. Accordingly, spin rate immediately after the hit and travel distance were measured. Mean values of 10 times measurement are shown in Table 2 and Table 3 below.

[Shot with Short Iron]

To the swing machine described above was attached an approach wedge. Then the machine condition was set to give the head speed of 21 m/sec, and the golf balls were hit therewith. Accordingly, spin rate immediately after the hit was measured. Mean values of 10 times measurement are shown in Table 2 and Table 3 below.

[Evaluation of Feeling]

Using a driver, the golf balls were hit by a high-level golf player. Then, the golf player rated the feeling into four ranks of from A to D based on the following criteria:

A: extremely satisfactory;

B: satisfactory;

C: somewhat unsatisfactory; and

D: unsatisfactory.

The results are presented in Table 2 and Table 3 below.

[Evaluation of Extent of Wrinkle Generation]

To the swing machine described above was attached a pitching wedge. Machine height was adjusted such that the golf ball is hit at a leading edge of the club head. Then the machine condition was set to give the head speed of 37 m/sec, and the golf balls were hit therewith. Accordingly, the surface of the golf ball was visually observed, and the extent of a wrinkle was rated into four ranks of from A to D based on the following criteria:

A: wrinkle hardly generated;

B: wrinkle slightly generated;

C: wrinkle greatly generated; and

D: wrinkle greatly generated, with exposed mid layer.

The results are presented in Table 2 and Table 3 below.

[Evaluation of Durability]

The golf balls were rendered to hit on a metal plate repeatedly at a velocity of 45 m/s. Durability was rated into four ranks of from A to D based on the following criteria:

A: no breakage caused on 150 times hitting;

B: no breakage caused on 100 times hitting, although breakage caused on 150 times hitting;

C: no breakage caused on 50 times hitting, although breakage caused on 100 times hitting; and D: breakage caused on 50 times hitting.

The measurement was carried out on 6 golf balls. The results of rating which gave a maximum convergence are presented in Table 2 and Table 3 below.

TABLE 2

Results of evaluation

| | | Compara. example 1 | Example 1 | Example 2 | Example 3 | Compara. example 2 | Compara. eExample 3 | Example 4 |
|---|---|---|---|---|---|---|---|---|
| Mid layer | Thickness Tm (mm) | 1.4 | 1.5 | 1.5 | 1.5 | 1.5 | 1.5 | 1.5 |
| Reinforcing layer | Base polymer | epoxy | epoxy | epoxy | epoxy | epoxy | epoxy | polyurethane |
| | Thickness (μm) | 10 | 5 | 10 | 10 | 10 | 10 | 10 |
| Cover | Thickness Tc (mm) | 0.7 | 0.6 | 0.6 | 0.6 | 0.6 | 0.6 | 0.6 |
| | Type | d | d | c | d | e | f | d |
| | Hardness Hc | 47 | 47 | 42 | 47 | 54 | 58 | 47 |
| | Volume V ($cm^3$) | 3.63 | 2.91 | 2.91 | 2.91 | 2.91 | 2.91 | 2.91 |
| | Tc*Hc*V | 119.5 | 82.0 | 73.3 | 82.0 | 94.2 | 101.4 | 82.0 |
| | Hc*V | 170.6 | 136.7 | 122.2 | 136.7 | 157.1 | 168.8 | 136.7 |
| Shot with driver | Ball speed (m/s) | 72.5 | 72.7 | 72.6 | 72.6 | 72.9 | 73.0 | 72.7 |
| | Travel distance (m) | 273.4 | 275.2 | 274.6 | 274.8 | 277.1 | 277.1 | 275.2 |
| Shot with #5 iron | Spin rate (rpm) | 4850 | 4700 | 4800 | 4700 | 4650 | 4550 | 4700 |
| | Travel distance (m) | 171.0 | 173.7 | 172.7 | 173.9 | 173.7 | 175.6 | 173.7 |
| Spin rate upon shot with approach wedge (rpm) | | 6700 | 6700 | 6800 | 6750 | 6200 | 5900 | 6700 |
| Feeling | | D | A | A | A | B | C | A |
| Extent of wrinkle | | A | A | A | A | A | A | A |
| Durability | | A | A | A | A | A | A | A |

TABLE 3

Results of evaluation

| | | Example 5 | Example 6 | Example 7 | Example 8 | Example 9 | Example 10 |
|---|---|---|---|---|---|---|---|
| Mid layer | Thickness Tm (mm) | 1.5 | 1.6 | 1.6 | 2.0 | 2.0 | 2.0 |
| Reinforcing layer | Base polymer | — | epoxy | epoxy | epoxy | epoxy | epoxy |
| | Thickness (μm) | — | 10 | 10 | 10 | 10 | 50 |
| Cover | Thickness Tc (mm) | 0.6 | 0.5 | 0.5 | 0.1 | 0.1 | 0.1 |
| | Type | d | d | e | a | b | b |
| | Hardness Hc | 47 | 47 | 54 | 28 | 33 | 33 |
| | Volume V ($cm^3$) | 2.91 | 2.36 | 2.36 | 0.55 | 0.55 | 0.55 |
| | Tc*Hc*V | 82.0 | 55.5 | 63.7 | 1.8 | 1.8 | 1.8 |
| | Hc*V | 136.7 | 110.9 | 127.4 | 15.4 | 18.2 | 18.2 |
| Shot with driver | Ball speed (m/s) | 72.7 | 72.8 | 73.1 | 73.2 | 73.1 | 73.3 |
| | Travel distance (m) | 275.2 | 276.1 | 277.4 | 279.7 | 278.0 | 278.4 |
| Shot with #5 iron | Spin rate (rpm) | 4700 | 4650 | 4400 | 4500 | 4350 | 4300 |
| | Travel distance (m) | 173.7 | 174.7 | 177.4 | 177.9 | 178.3 | 178.6 |
| Spin rate upon shot with approach wedge (rpm) | | 6700 | 6700 | 6500 | 6850 | 6800 | 6800 |
| Feeling | | A | A | A | A | A | A |
| Extent of wrinkle | | D | A | A | C | B | A |
| Durability | | D | A | A | A | A | A |

As is clear from Table 2 and Table 3, the golf ball of each of Examples is excellent in the flight performance upon shots with a driver and a middle iron, in the spin performance upon shots with a short iron, and in the feeling. Accordingly, advantages of the present invention are clearly indicated by these results of evaluation.

The description herein above is merely for illustrative examples, and various modifications can be made without departing from the principles of the present invention.

What is claimed is:

1. A golf ball which comprises a spherical core, a mid layer positioned outside of the core, a cover positioned outside of the mid layer, and a reinforcing layer provided between said mid layer and said cover, said cover having a thickness Tc of equal to or less than 0.5 mm, said cover having a hardness Hc as measured with a Shore D type hardness scale of equal to or less than 47, said cover having a volume V of equal to or less than 2.4 $cm^3$, and a product obtained by multiplying the thickness Tc (mm), the hardness Hc and the volume V ($cm^3$) of said cover being equal to or less than 90, and a product obtained by multiplying the hardness (Hc) and the volume V ($cm^3$) of said cover being equal to or less than 115, wherein a principal component of the base polymer of said cover is a thermoplastic polyurethane elastomer, and wherein a principal component of the base polymer of said mid layer is an ionomer resin, wherein an isocyanate component of the thermoplastic polyurethane elastomer is an alicyclic diisocyanate, and wherein a base polymer of said reinforcing layer is a two-component cured thermosetting resin obtained by curing a bisphenol A type epoxy resin with a polyamide based curing agent containing a polyamide amine or denatured product of the polyamide amine.

2. The golf ball according to claim 1, wherein said reinforcing layer has a thickness of 3 μm or greater and 50 μm or less.

3. The golf ball according to claim 1, wherein the product obtained by multiplying the hardness (He) and the volume V ($cm^3$) of said cover is equal to or less than 115 and equal to or greater than 10.

4. The golf ball according to claim 1, wherein the cover has a thickness Tc equal to or less than 0.4 mm and equal to or greater than 0.1 mm; and the cover has a volume V equal to or less than 2.2 $cm^3$ and equal to or greater than 0.3 $cm^3$.

5. The golf ball according to claim 1, wherein the cover has a thickness Tc equal to or less than 0.4 mm and equal to or greater than 0.2 mm; and the cover has a volume V equal to or less than 2.2 $cm^3$ and equal to or greater than 1.0 $cm^3$.

6. The golf ball according to claim 1, wherein the product obtained by multiplying the thickness Tc (mm), the hardness Hc and the volume V ($cm^3$) of said cover being equal to or less than 85, and is equal to or greater than 1.0.

7. The golf ball according to claim 1, wherein the product obtained by multiplying the thickness Tc (mm), the hardness Hc and the volume V ($cm^3$) of said cover being equal to or less than 60, and is equal to or greater than 1.0.

8. The golf ball according to claim 1, wherein the isocyanate component is 4,4'-dicyclohexylmethane diisocyanate.

9. The golf ball according to claim 1, wherein a ratio of epoxy equivalent of the epoxy resin and amine active hydrogen content equivalent of the polyamide based curing agent is 1.0/1.4 or greater and 1.0/1.0 or less.

* * * * *